US005273407A

United States Patent [19]

Jarchau et al.

[11] Patent Number: 5,273,407

[45] Date of Patent: Dec. 28, 1993

[54] HOMOGENIZING SYSTEM HAVING IMPROVED FLUID FLOW PATH

[75] Inventors: Michael Jarchau, Luebeck; Ralf Priebe, Strenglin; Klaus Lindemann, Luebeck, all of Fed. Rep. of Germany

[73] Assignee: APV Gaulin GmbH, Lubeck, Fed. Rep. of Germany

[21] Appl. No.: 876,046

[22] Filed: Apr. 30, 1992

[51] Int. Cl.[5] ..... F04D 11/00

[52] U.S. Cl. ..... 417/539; 417/63; 417/430; 417/568; 138/45; 73/730

[58] Field of Search ..... 138/44, 45, 46; 137/528, 540, 533.21; 73/730, 756, 714; 417/63, 430, 539, 568

[56] References Cited

U.S. PATENT DOCUMENTS

| | | | |
|---|---|---|---|
| 3,185,103 | 5/1965 | Yohpe | 417/539 |
| 4,251,053 | 2/1981 | Wurzer | 417/568 |
| 4,277,229 | 7/1981 | Pacht | 417/539 |
| 4,477,236 | 10/1984 | Elliott | 417/568 |
| 4,477,247 | 10/1984 | Grable | 417/539 |
| 4,534,224 | 8/1985 | Raftis | 73/730 |
| 4,763,527 | 8/1988 | Raftis | 73/730 |
| 4,773,833 | 9/1988 | Wilkinson et al. | 417/539 |
| 4,773,833 | 9/1988 | Wilkinson et al. | 417/539 |

OTHER PUBLICATIONS

Huub L. M. Lelieveld, In: *Biotechnology and Bioengineering*, XVIII, John Wiley & Sons, Inc., New York, pp. 1807-1810 (1976).

D. A. Timperley and H. L. M. Lelieveld, In: *Antonie van Leeuwenhoek* 46, p. 499 (1980).

C. T. Verrips and J. Zaaelberg, In: *European J. Appl. Microbiol. biotechnol.* 10, 187-196 (1980).

C. T. Verrips, et al. In: *European J. Appl. Microbiol. Biotechnol.* 10, 73-83 (1980).

H. L. M. Lelieveld, "Hygienic design and test methods", Unilever Research Laboratory, Vlaardinger, The Netherlands.

H. L. M. Lelieveld, "Processing Equipment and Hygienic Design", Symposium Proceedings, Campden Food & Drink Research Association, Chipping, Campden, Feb. 6-8, 1990.

Hygienic Plant Engineering Requirements, Unilever Research & Engineering, Apr. 1991, First Edition.

*Primary Examiner*—Richard A. Bertsch
*Assistant Examiner*—Charles G. Freay
*Attorney, Agent, or Firm*—Hamilton, Brook, Smith & Reynolds

[57] ABSTRACT

A homogenizer comprises a homogenizing valve mounted to a pump block. The pump has multiple plungers housed in a set of pump chambers formed through a surface of the pump block. Sets of suction valves and discharge valves are positioned in valve bores formed through the block intersecting the pump chambers. During homogenization, each plunger reciprocates in a pump chamber to draw fluid through a suction valve and the pump chamber and discharge that fluid through a discharge valve and subsequently to the homogenizing valve. The homogenizer has a plurality of seals located along its fluid flow path and positioned to have a surface exposed directly to the fluid. As such, the homogenizer is characterized by the absence of recessed seals along the fluid flow path and provides an internal geometry in which microorganism growth and fluid residue buildup are minimized.

17 Claims, 5 Drawing Sheets

HOMOGENIZING SYSTEM HAVING IMPROVED FLUID FLOW PATH

BACKGROUND

Homogenization is the breaking down and mixing of the components of an emulsion or dispersion. A major use of homogenizers is to break down and disperse milk fat into the bulk of skim milk. This delays creaming of milk fat globules. Homogenizers are also used to process other emulsions such as silicon oil and to process dispersions such as pigments, antacids and various paper coatings.

In the most widely used type of homogenizer, the emulsion is introduced at high pressure of from 500 psi to 10,000 psi to a central bore within an annular valve seat. The emulsion is forced out through a narrow gap between the valve seat and a valve member. Through the gap, the emulsion undergoes extremely rapid acceleration as well as an extreme drop in pressure. This violent action through the valve breaks down globules within the emulsion to produce the homogenized product.

The degree of homogenization is a function of the difference between the pressure of the emulsion at the inlet of the valve and the pressure at the outlet. In the past, homogenizers have not typically been required to operate at pressures of greater than 10,000 psi. However, recent applications such as cell disruption have required significantly higher pressures of about 15,000 psi or more.

A typical homogenizer system includes a homogenizer valve mounted to the side of a pump block. The pump is a plunger pump having multiple plungers which draw fluid from a common suction manifold and discharge it into a common discharge manifold delivering high pressure fluid to the homogenizer valve. The suction and discharge manifolds are cross bores which extend parallel to opposite faces of the block. Valve bores drilled through one of those faces join the two manifolds, and a valve assembly is positioned at each end of each of those valve bores. Another set of bores is drilled through an adjacent face of the block to form pump chambers which house the plungers. Each pump chamber intersects each valve bore at a 90 degrees angle. Each plunger reciprocates in a pump chamber to draw fluid through a suction valve from the suction manifold and force the fluid through the discharge valve into the discharge manifold which is connected to the homogenizer valve. As such, the homogenizer has a primary fluid flow path extending from the suction manifold and through the suction valves, the pump chambers, the discharge manifold and the homogenizer valve.

For a constant flow rate pump, a desired homogenizing pressure is maintained by adjusting the gap between the valve member and the valve seat. In conventional systems, that adjustment is made by an actuator assembly which may be a spring-loaded handwheel or a hydraulic or pneumatic actuator system. The hydraulic or pneumatic system provides for regulating of the process via a control panel, eliminating the need for manual adjustments.

SUMMARY OF THE INVENTION

Homogenizing systems used for food processing are typically subjected to a daily cleaning procedure in which the primary fluid flow path is flushed with cleaning fluids. More specifically, the primary flow path is initially flushed with an acid solution, followed by a neutralizing agent for neutralizing the acid. Next, the flow path is flushed with water, followed by a chlorine solution for sanitization. Although this flushing procedure effectively removes residue which collects along smooth areas of the primary flow path, it is not very effective in removing residue buildup in crevices, stagnant areas, corners and mating surfaces along the flow path which are caused mainly by recessed seals. As such, homogenizing systems require a disassembly cleaning procedure or a frequent high-intensity in-line cleaning to remove residue buildup along the primary flow path.

A goal of the present invention is to reduce costs for cleaning and sanitizing of a homogenizing system by decreasing:

(1) the time and/or frequency of cleaning processes, (2) the required volume/concentration of cleaning agents, (3) waste production caused by cleaning, and (4) the required energy for cleaning procedures.

Accordingly, the homogenizer of the present invention has an internal geometry which is substantially free of all crevices, corners and stagnant areas such that residue buildup along the primary flow path is minimized. The present invention is directed to various features relating to the homogenizer's internal geometry which are described in detail below. A homogenizer of the present invention is particularly useful in a Cleaning In Place (CIP) or Sterilization In Place (SIP) homogenizing system in that dismantling of the system for an intensive cleaning procedure is not necessary for extended periods of time. The present invention significantly extends the period between required cleaning procedures, and daily flushing of the homogenizer with a lower volume concentration of cleaning agents is a sufficient cleaning procedure for extended periods of time.

In one embodiment, a homogenizer includes a homogenizing valve mounted to a pump block. A set of one or more pump chambers is formed in the block. Suction valves and discharge valves are positioned in respective suction valve bores and discharge valve bores. The valve bores are formed in the block and are in communication with the set of pump chambers. A primary fluid flow path extends through the suction valves, the suction valve bores, the pump chambers, the discharge valve bores, the discharge valves and the homogenizing valve. In accordance with the present invention, the homogenizer comprises exposed seals positioned along the primary flow path to have a surface which is flush with the fluid flow path. Preferably, the exposed seals are employed along the primary flow path in the pump chambers, the discharge valve bores and the homogenizing valve such that the buildup of residue is minimized, the growth of microorganisms is slowed and a proper contact between cleaning agents and sealing area is achieved.

In a detailed embodiment of the present invention, the homogenizing pump has an internal geometry with substantially all cracks, crevices and stagnant areas eliminated. To that end, an exposed seal is positioned in a radial step formed at the end of a pump bore through which fluid passes. The exposed seal is secured in the radial step by an axially directed peripheral ridge of a retaining member which is mounted to the pump closing the end of the bore. The seal is flush with the pump bore and an inner surface of the ridge. As such, a surface of the seal is directly exposed to the fluid flow path thereby minimizing fluid residue buildup and microorganism growth. In the present invention an exposed seal is positioned in a radial step formed in the end of each pump chamber and secured by an axially directed peripheral ridge of a retainer closing the pump chamber. The seal is flush with the pump chamber and an inner surface of the ridge and has a surface directly exposed to the fluid flow path. Another exposed seal is positioned on a radial step formed in each discharge valve bore and secured by the discharge valve assembly. The seal is flush with the discharge valve bore and inner surface of an axially directed peripheral ridge of the discharge valve assembly such that a surface of the seal is exposed to the fluid flow path.

The pump block is coupled to a homogenizer valve assembly comprising a valve seat with central bore into which fluid from the discharge manifold enters. A valve member within a valve body is spaced adjacent to the valve seat to provide a gap through which fluid is expressed. An impact ring surrounds the gap for directing the fluid into a peripheral chamber or region. In accordance with the present invention, the impact ring is shrink fitted about the valve member, providing a zero clearance crevice between the impact ring and valve member. As such, microorganism growth in the crevice is slowed and fluid residue buildup is minimized.

The homogenizing valve assembly further comprises an actuator assembly having a shaft for actuating the valve member to adjust the gap. In accordance with the present invention, an exposed dynamic seal is coupled to the valve body and to the shaft adjacent to the peripheral region. The dynamic seal is preferably an elastomer seal which flexes as the shaft is translated.

A flow through high pressure gauge assembly is mounted to the pump block for measuring outlet (or inlet) pressures. A flow-through type of pressure gauge is used because it has no dead space along its flow channel. In accordance with the present invention, the pressure gauge assembly has a flow channel comprising a pair of exposed seals, wherein each seal is located on a radial step at an end of the flow channel. The seals are flush with the flow channel and the primary flow path of the pump. When employed for measuring outlet pressure from the pump, the pressure gauge assembly is mounted between the pump block and the homogenizing valve assembly. The pressure gauge assembly is axially clamped to the pump block, thereby securing the one exposed seal against the block and the other exposed seal against the homogenizing valve assembly.

BRIEF DESCRIPTION OF THE DRAWINGS

The foregoing and other objects, features and advantages of the invention will be apparent from the following more particular description of preferred embodiments of the invention, as illustrated in the accompany drawings in which like reference characters refer to the same parts throughout the different views. The drawings are not necessarily to scale, emphasis instead being placed on illustrating the principles of the invention.

DETAILED DESCRIPTION OF A PREFERRED EMBODIMENT

Figure 1A:
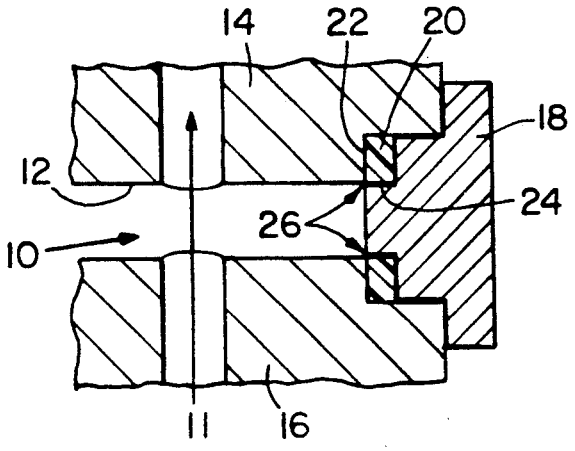
Fig. 1A (PRIOR ART)
FIG. 1A is a partial cross-sectional view of primary fluid flow path of a prior art homogenizing system.

Homogenizing systems are subjected to a daily cleaning procedure wherein the primary fluid flow path is flushed with cleaning fluids. In prior art homogenizers having recessed seals, this procedure is not completely effective in removing residue buildup in crevices, cul-de-sacs, dead-ends, tight internal radius areas, stagnant areas, corners and mating surfaces along the flow path caused by recessed seals. For example, a section of a primary fluid flow path 11 of a prior art homogenizing system is shown in FIG. 1A. The flow path 11 intersects a bore 10 formed in a conduit 12 defined by a first structure 14 and a second structure 16. An end of the bore 10 is closed by a cap 18. A recessed seal 20 is located in a step 22 in the bore 10 adjacent to the cap 18, creating a crevice 24 and corners 26 at which residue buildup occurs or microorganisms can survive.

Figure 1B:
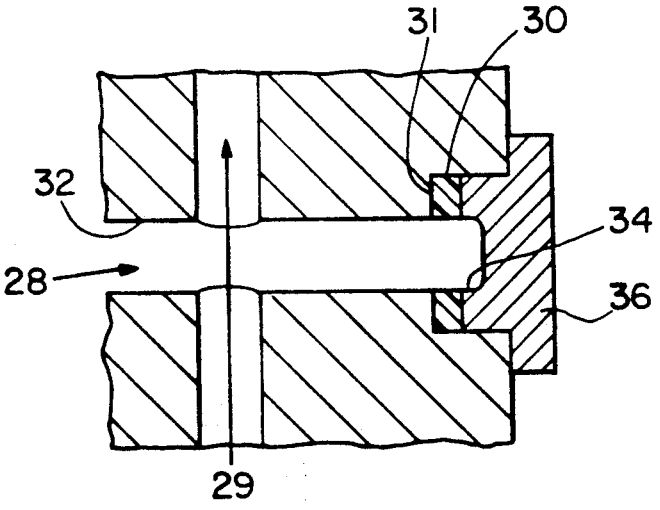
FIG. 1B is a partial cross-sectional view of a primary fluid flow path of a homogenizing system of the present invention.

In the present invention, the homogenizer internal geometry is configured such that exposed seals may be positioned along the primary flow path to have a surface flush with the flow path and exposed directly to the flow path for minimizing residue buildup and microorganism growth along the flow path. As such, a homogenizer embodying the present invention can operate for an extended period before a cleaning procedure is required. FIG. 1B illustrates a section of the primary flow path 29 of a homogenizing system embodying the basic principle of the present invention. The flow path 29 intersects a bore 28 formed in a conduit 32. An exposed seal 30 is positioned on a radial step 31 of the bore 28 adjacent to an axially directed peripheral ridge 34 of a cap 36. As such, a surface of the seal 30 is directly exposed to the primary flow path 29, while the remaining three surfaces are fully sealed. Employing this configuration, the crevice and the corners as well as potential (see FIG. 1A) residue buildup in those areas are eliminated.

Figure 2:
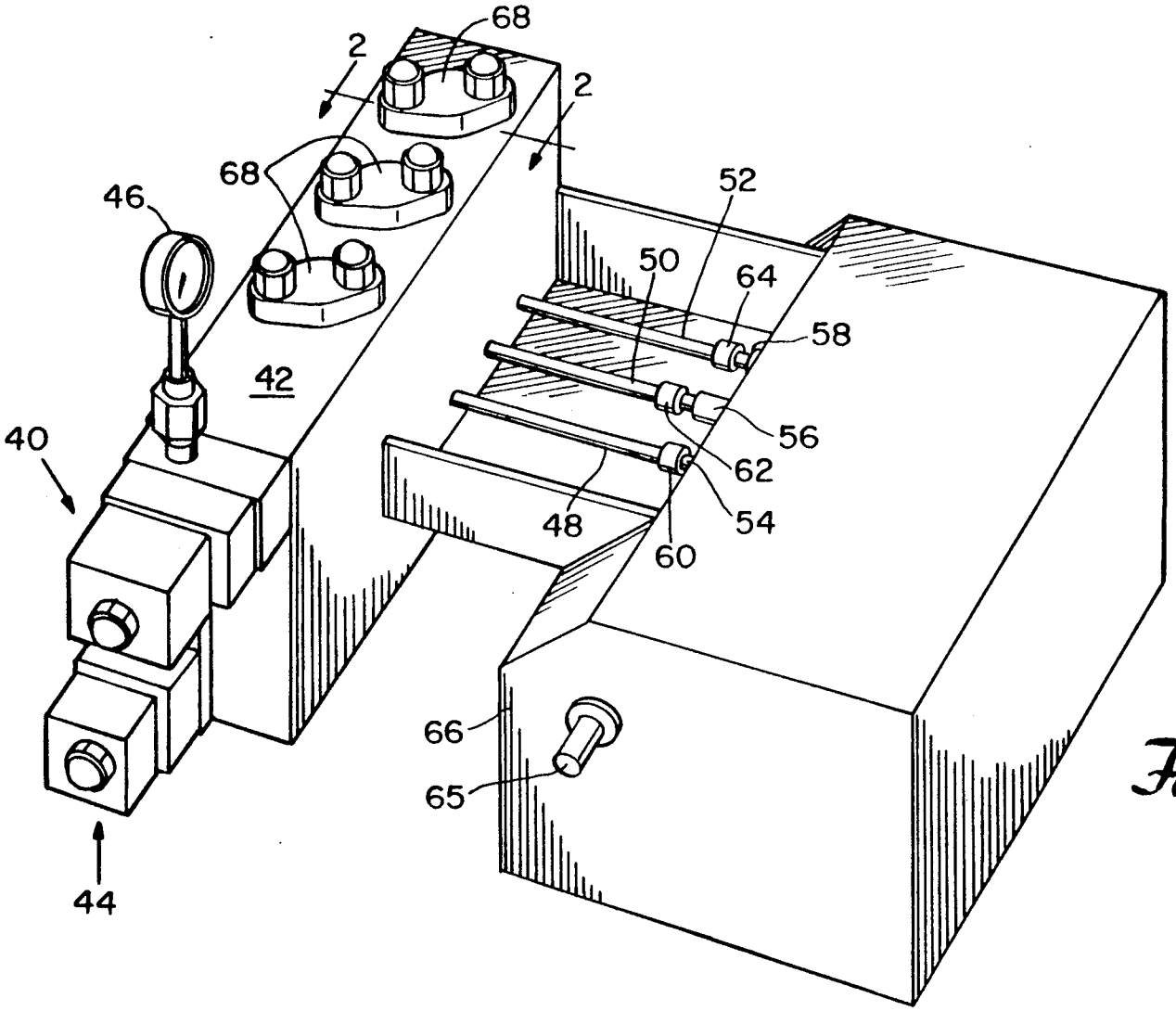
FIG. 2 is a perspective view of a homogenizer valve and pump assembly embodying the present invention.

FIG. 2 is a perspective view of a homogenizer system embodying the present invention. The view is from a direction which a user would consider to be the rear of the system to show the plunger drive. A homogenizer valve assembly 40 is mounted to a pump block 42. The valve assembly receives pressurized fluid from the pump, and the homogenized fluid is discharged through a flanged port 44 (also see FIG. 5). Pressure of the fluid entering the homogenizer system can be monitored by a high pressure gauge (not shown), and pressure of the fluid entering the homogenizer valve assembly 40 can be monitored by a high pressure gauge 46 mounted to the block 42.

The pump comprises three plunger pumps which operate, in parallel, 120° out of phase with each other. A plunger 48, 50 and 52 is coupled to a respective drive shaft 54, 56, and 58 by means of a compression coupling 60, 62 and 64. The drive shafts are driven through an eccentric shaft 65 located in box 66 by an electric motor (not shown). A set of three suction valves are located along the bottom of the block 42, and a set of three discharge valves are located along the top of the block and may be accessed by removal of top caps 68.

Figure 3:
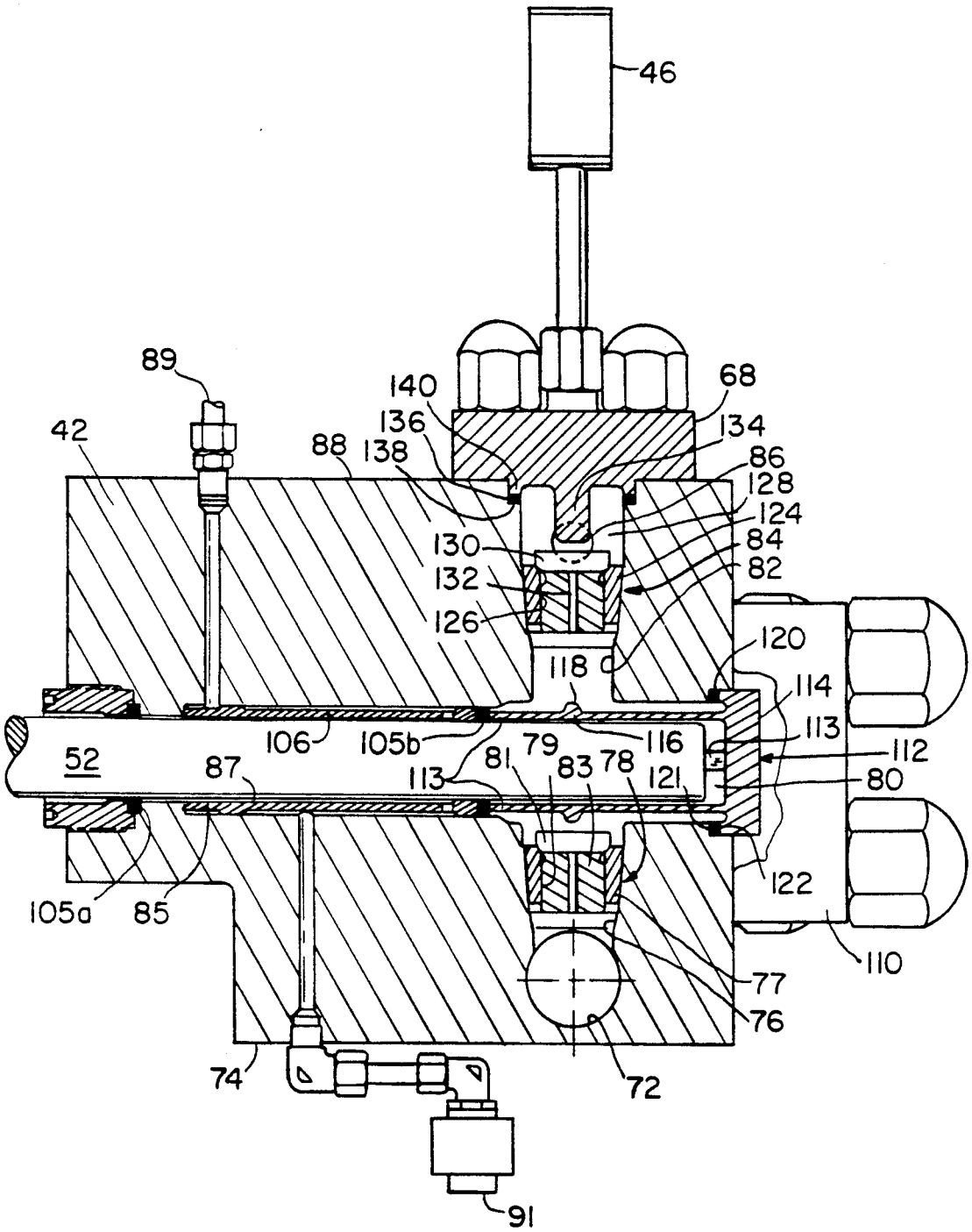
FIG. 3 is a cross-sectional view of the pump of FIG. 2 taken along line 2—2.
Figure 4:
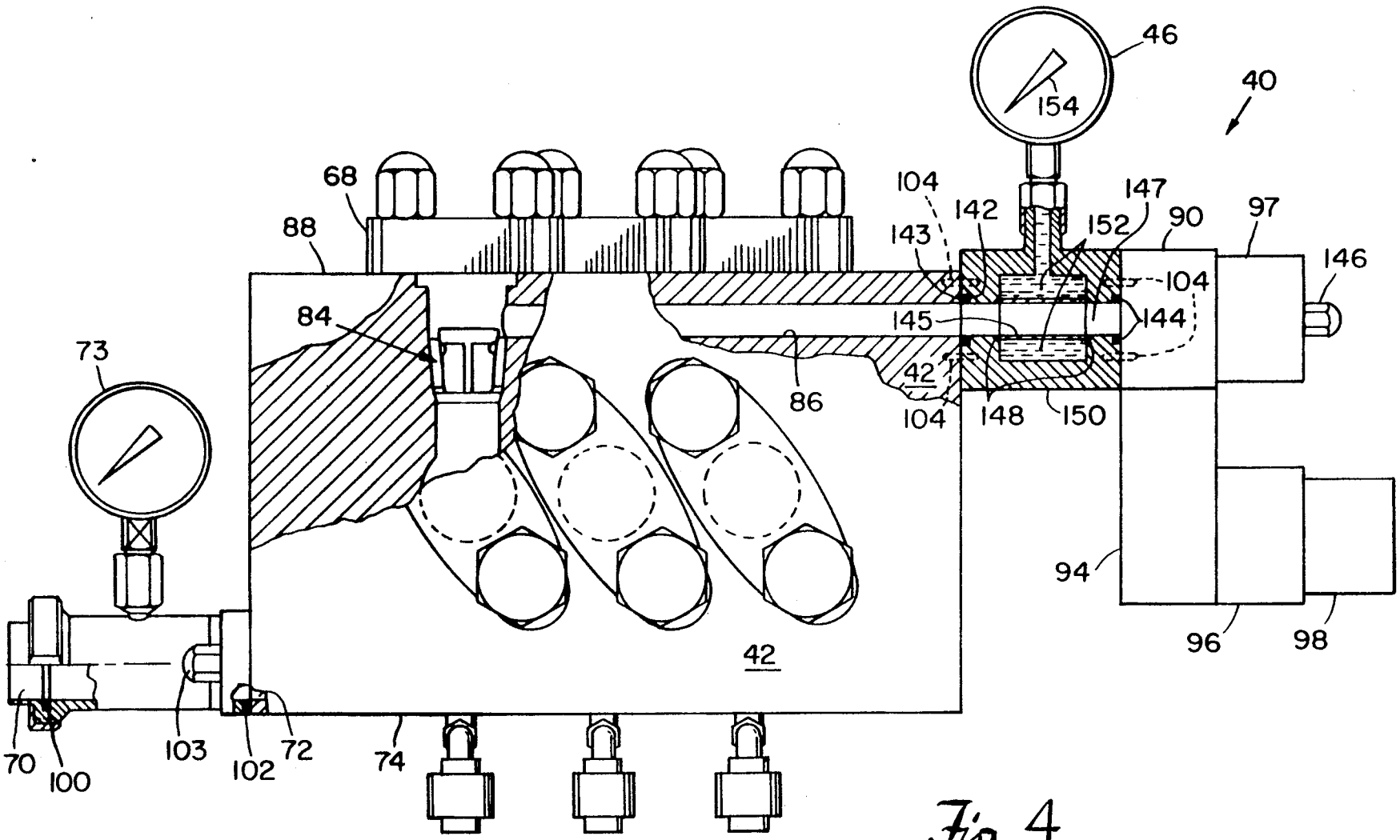
FIG. 4 is a elevational view, partially broken away, of the system FIG. 2 as viewed from the rear of FIG. 2.

As shown in FIG. 4, fluid is drawn into the pump 42 through a flanged port 70 into a manifold 72. The pressure gauge 73 is coupled to the manifold 72 and provides an indication of the inlet fluid pressure. The manifold 72 is a cross-bore extending through the block parallel to the bottom face 73 without dead ends. The manifold extends through a set of three parallel suction valve bores 76. One of these valve bores is illustrated in FIG. 3. A suction valve assembly 78 is positioned in each bore.

As shown in FIG. 3, the suction valve 78 communicates with a pump chamber 80 through the suction valve bore 76. The plunger 52 drives fluid from the pump chamber 80 through a discharge valve bore 82 to a discharge valve assembly 84. The discharge valve assembly 84 is positioned in the bore 82 which communicates with a discharge manifold 86 without dead ends. The discharge manifold 86 is also a cross-bore and is parallel to the upper face 88 of the block 42. There are three discharge valves 84 in communication with the manifold 86 and covered by the top caps 68. However, it should be noted that any number of plunger pumps capable of providing a relatively constant flow rate fluid to the homogenizing valve 40 may be employed without departing from the scope of the present invention.

Figure 5:
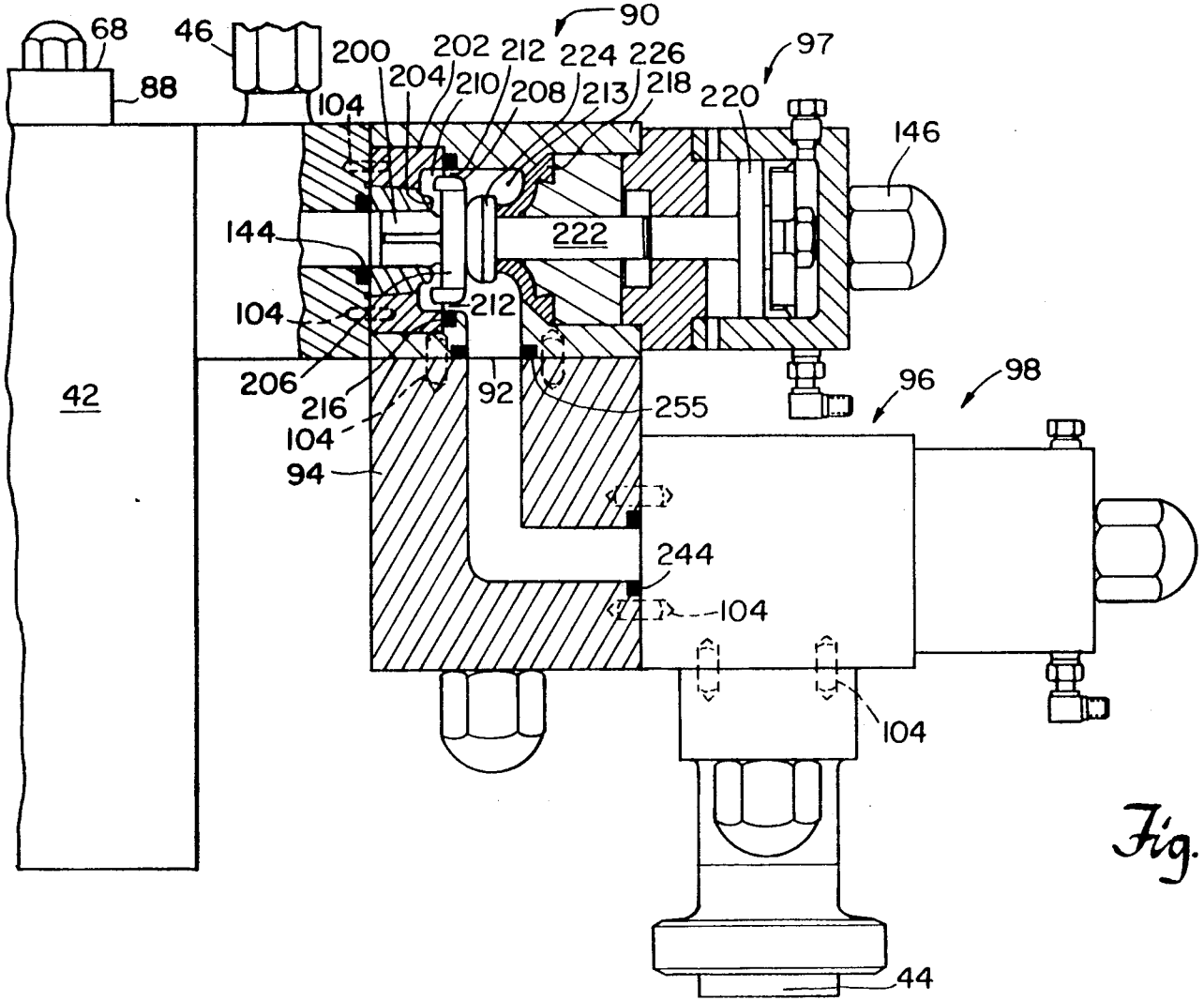
FIG. 5 is a cross-sectional view of the homogenizer valve and actuator valve assembly of the system of FIG. 2.

Referring to FIG. 4, the fluid from the three discharge valves 84 is directed by the manifold 88 to the homogenizing valve assembly 40. As shown in FIG. 5, the fluid is introduced into a first stage homogenizing valve 90 for homogenization. The homogenized fluid is directed from the first stage valve 90 to a discharge port 92. An elbow conduit 94 directs the homogenized fluid to a second stage homogenizing valve 96 for further homogenization. The second valve 96 functions identically to the first valve 90 except at a different pressure gradient. The final homogenized product exits the second valve 96 through the discharge port 44. The pump 42 is a constant volume pump, and pressure is maintained by adjusting the two homogenizing valves 90 and 96. Those adjustments are made by a pair of hydraulic (or pneumatic) actuators 97 and 98 which are described in detail below.

In accordance with the present invention, a plurality of exposed seals are positioned along the primary flow path of the homogenizer. These exposed seals are located in the pump chambers, the discharge valve bores, the pressure gauge blocks and the homogenizing valve as described in detail below.

As shown in FIG. 4, the high pressure gauge 73 is mounted to the flanged port 70 to monitor the pressure of fluid entering at the suction manifold 72. The gauge 73 is a flow-through diaphragm tube type of pressure gauge (described below) useful for high pressure applications. Fluid entering from the port 70 flows through the gauge 73 and enters the suction manifold 72. A pair of exposed seals 100 and, 102 are positioned along flow path of the pressure gauge 73. A nut 103 is employed for axially clamping the pressure gauge 73 to the pump block 42, thereby securing the seal 102 against the block.

Referring back to FIG. 3, fluid from the manifold 72 is drawn into the suction valve bore 76. The valve assembly 78 positioned in the bore 76 comprises a valve seat 77 having a central channel 79 in communication with the suction manifold. A valve member 81 provides fluid communication from the channel 79 to the pump chamber 80 and closes the channel 79 when positive back pressure is applied. Further, the valve member 81 has a member 83 which serves as a guide.

The pump chamber 80 is formed in the block 42 parallel to the upper and lower faces (88 and 74) of the block. The plunger 52 is driven in a bearing 85 in which a fluid or steam is passed through an annulus 87 from a port 89 to a discharge port 91 either for flushing microorganisms to the drain or for simply inactivating them. A pair of seals **105*a* and 105*b* formed of packing are positioned adjacent to a ring 106 and maintain a dynamic seal. One of the packing seals 105*b* rests against the pump block in the pump chamber and is pressed against the ring 106 by a retainer 112 as the end 110 is bolted onto the block 42**.

The retainer 112 has fingers 113 extending from a cap 114 pressing against the exposed surface of the packing seal **105*b*. The fingers 113 are sufficiently small so that the area adjacent to the exposed packing surface does not become a source of fluid residue build up. The retainer 112 also has a ring 116 attached to the fingers 113 for stabilization thereof. The ring 116 has a ridge 118 along its periphery which serves as a valve stop for the suction valve 78**.

The retainer 112 is positioned against an exposed seal 120 located in a radial step 121 formed in the pump chamber 80. As the end cap 110 is bolted onto the block, an axially extending peripheral ridge 122 of the cap is pressed against the seal 120. The seal 120 is flush with the pump chamber 80 and an inner surface of the ridge 122 such that a surface of the seal is directly exposed to the fluid flow path. The base of the ridge has a concave shape to avoid a debris collecting corner.

The plunger 52 drives fluid from the pump chamber 80 to the discharge valve bore 82. The discharge valve assembly 84 positioned in the bore 82 comprises a valve seat 124 having a central channel 126 in communication with a plenum 128 and the discharge manifold 86. A valve member 130 is positioned in the channel 126 to provide fluid communication with the plenum 128 and has a member 132 which serves as a guide. A top cap 68 has a nose portion 134 which serves as a valve stop for the valve 84. The nose 134 is positioned adjacent to an exposed seal 136 located in a radial step 138 formed the bore 82. As the cap 68 is bolted onto the block, an axially extending peripheral ridge 140 of the nose 134 is pressed against the seal 136. The seal 136 is flush with the bore 82 and an inner surface of the ridge 140 such that a surface of the seal is directly exposed to the fluid flow path.

As shown in FIG. 4, fluid from the discharge valves is directed by the manifold 86 through a pressure gauge 46 to the homogenizer valve assembly 40. The high pressure gauge is mounted to the pump block for monitoring the pressure of fluid entering the homogenizer valve assembly 40. The gauge 46 is a flow-through diaphragm tube type pressure gauge useful for high pressure monitoring. In accordance with the present invention, the gauge 46 has an internal geometry which minimizes residue buildup and microorganism growth along its flow channel. To that end, fluid exiting the pump 42 passes through the flow channel 147 created by the tube diaphragm 145. The tube diaphragm 145 is a thin-walled annular membrane that is welded (at 148) to the gauge block 150 along the flow channel 147., The membrane 145 is welded such that it is flush with the gauge block 150 along the flow channel 147. Pressurized fluid passing through the flow channel 147 pushes against the diaphragm causing it to be displaced. The displacement of the diaphragm changes the volume of the liquid region 152 which, in turn, changes the reading of the pressure gauge indicator 154.

A pair of exposed seals 142 and 144 employed in the pressure gauge 46 have a surface exposed to the fluid flow path. Each seal is positioned on a respective radial step along the flow channel of the gauge 46 such that it is flush with the fluid flow path and the flow channel. A nut 146 is employed for axially clamping the gauge to the pump block to secure the seal 142 against the pump block and the seal 144 against the homogenizing valve assembly.

An exposed seal such as the seal 142 is constructed as follows. An edge 143 of the seal perpendicular to the exposed edge is given a calculated angle for ensuring a defined compression of the sealing lip close to the fluid flow path. As such, no microorganisms can be trapped under the three non-exposed surfaces of the seal 142. For some exposed seals, such as the seal 142, centering pins 104 are employed to prevent the occurrence of a step (not shown) along the fluid flow path of adjacent parts (42 and 46) sealed by the exposed seal 142. This step would cause a second side 143 of the seal to be exposed, creating a corner capable of fluid residue buildup or microorganism growth.

The pressurized fluid passes through the pressure gauge and is introduced to the homogenizing valve assembly 40. As shown in FIG. 5, the homogenizing valve assembly 40 is a two-stage unit having the first stage homogenizing valve 90 in series with the second stage homogenizing valve 96. A two-stage Hydraulic Valve Actuator (HVA) assembly comprises actuators 97 and 98 which are employed to control the process pressure associated with the first and second stage valves 90 and 96 respectively.

Pressurized fluid is introduced into the first stage valve 202 through a central bore 200 in an annular valve seat 202. The fluid is directed from the bore 200 radially outward through a gap 204 formed between the valve seat 202 and a valve member 206. An impact ring 208 surrounds the gap 204 and directs the homogenized fluid to channel 210 formed between the ring 208 and the valve seat 202. The impact ring 208 and the valve member 206 are constructed as a shrink fit assembly to avoid crevices and dead space. Alternatively, the impact ring 208 and valve member 206 may be a single piece assembly without departing from the scope of the present invention.

The homogenized fluid travels through the channel, 210 to port 212, a plenum 213 and the discharge port 92. Seal 216 is positioned adjacent to the channel 210 between the valve seat 202 and the first stage valve body 218. The seal 216 is flush with the valve seat 202 and the valve body 218 such that a surface of the seal 216 is directly exposed to the fluid flow path.

The homogenizing pressure for the first stage valve 90 is maintained by adjusting the gap 204 using the actuator 90. To reduce the size of the gap, high pressure hydraulic fluid (or pneumatic force) presses downwardly against a piston 220 to force movement of a piston rod 222 and a member 224. The member 224 is forced downwardly against the valve member 206 closing the gap 204. If on the other hand, the hydraulic pressure is reduced, the valve member 206 is able to move away from the valve seat 202 to increase the gap 204.

An exposed elastomer seal 226 partially defines the plenum 213 and thus has a surface exposed to the fluid flow path. One end of the seal 226 is cemented to and clamped against the valve body 218 and the other end is cemented to the rod 222 and member 224. As the rod 222 is translated to adjust the gap 204, the seal 226 flexes to provide a dynamic seal within the plenum 212.

The homogenized fluid is directed from the port 92 through an elbow conduit 94 to the second stage homogenizing valve 96. An exposed seal 255 is positioned in a notch in the first stage valve 96 adjacent to the elbow conduit 94. A surface of the seal 255 is exposed to the fluid flow path to minimize fluid residue buildup at the valve/conduit interface. Another seal 244 is located in the elbow conduit 94 and has a surface exposed to the fluid flow path. The seal 244 is positioned in a notch in the elbow conduit 94 adjacent to the second stage valve 96. The second stage valve 96 serves two important functions. By establishing controlled back pressure, the second stage valve concentrates the energy of the first stage homogenizing zone to ensure maximum efficiency. By utilizing the same principals as the first stage valve, but a lower pressure gradient, it minimizes the possibility of clumping and coalescence. The second stage valve 96 performs further homogenization on the fluid, and the final product is directed from the valve 96 through the discharge port 44. Upside-down mounting of the homogenizing valve assembly assures self-draining performance.

While the invention has been particularly shown and described with reference to preferred embodiments thereof, it will be understood by those skilled in the art that various changes in form and details may be made therein without departing from the spirit and scope of the invention as defined by the appended claims. For example, although- not specifically shown, a single stage homogenizing valve and actuator assembly may be used. However, when relatively low homogenizing pressures are required, any two-stage homogenizing valve assembly may be employed in accordance with the scope of the present invention.

What is claimed is:

1. A homogenizing pump comprising:

a pump block;

a bore formed in the pump block, a fluid flow path of the pump passing through the bore;

a retaining member located at an end of the bore;

a seal located along the fluid flow path on a radial step in the bore adjacent to an axially directed peripheral ridge of the retaining member, the seal being flush with the bore and an inner surface of the ridge.

2. A homogenizing pump as claimed in claim 1 wherein the bore is a pump chamber formed in the pump block.

3. A homogenizing pump as claimed in claim 1 wherein the bore is a discharge valve bore formed in the pump block and coupled to a pump chamber and the retaining member is a discharge valve assembly positioned at an end of the discharge valve bore.

4. A homogenizing pump as claimed in claim 1 further comprising a flow-through pressure gauge assembly mounted to the pump block and having a fluid flow channel in communication with the fluid flow path of the pump, the pressure gauge assembly comprising a seal located on a radial step along the fluid flow channel of the pressure gauge assembly, the seal being flush with the fluid flow path and the fluid flow channel, the pressure gauge assembly being axially clamped to the pump block for securing the seal against the pump block.

5. A homogenizing valve assembly comprising:

a valve body;

a valve seat located within the valve body;

a valve member located within the valve body spaced adjacent to the valve seat to provide a gap through which the fluid is expressed into a peripheral region; and an impact ring surrounding the gap for directing the expressed fluid into a peripheral region, the impact ring being shrink fitted about the valve member.

6. A homogenizing valve assembly as claimed in claim 5 further comprising:

an actuator assembly having a translatable shaft for actuating the valve member to adjust the gap; and a dynamic seal located adjacent to the peripheral region and coupled to the valve body and the translatable shaft, the dynamic seal flexing as the shaft is translated.

7. A homogenizer comprising:

a pump block;

a pump chamber formed through the pump block and comprising a seal located along a fluid flow path of the homogenizer on a radial step within the pump chamber adjacent to an axially directed peripheral ridge of a retaining member positioned at the end of the chamber, the seal being flush with the pump chamber and an inner surface of the ridge;

a suction valve assembly coupled to the pump chamber;

a suction valve bore housing the suction valve assembly and coupling the suction valve assembly to the pump chamber;

a discharge valve assembly coupled to the pump chamber;

a discharge valve bore housing the discharge valve assembly and coupling the discharge valve assembly to the pump chamber, the discharge valve bore comprising a seal located on the fluid flow path of the homogenizer on a radial step within the discharge valve bore adjacent to an axially directed peripheral ridge of the discharge valve assembly, the seal being flush with the discharge valve bore and an inner surface of the ridge; and a homogenizing valve assembly coupled to the pump block and in communication with the discharge bore.

8. A homogenizer as claimed in claim 7 further comprising a flow-through pressure gauge assembly mounted between the pump block and the homogenizing valve assembly and having a flow channel in communication with the fluid flow path of the homogenizer, the pressure gauge assembly comprising a pair of seals each being located along the fluid flow path of the homogenizer on a radial step of flow channel of the pressure gauge assembly, the seals being flush with the fluid flow path and the flow channel, the pressure gauge being axially clamped to the pump block so as to secure one of said pair of seals against the pump block and the other of said pair of seals against the homogenizing valve assembly.

9. A homogenizer as claimed in claim 7 wherein the homogenizing valve comprises:

a valve body;

a valve seat within the valve body;

a valve member within the valve body spaced adjacent to the valve seat to provide a gap through which the fluid is expressed, and an impact ring surrounding the gap for directing the expressed fluid into a peripheral region, the impact ring being shrink fitted to an axially directed surface of the valve member.

10. A homogenizer as claimed in claim 9 wherein the homogenizing valve further comprises:

an actuator assembly having an actuator rod for actuating the valve member to adjust the gap; and a dynamic seal located adjacent to the peripheral region and coupled to the valve body and the translatable shaft, the dynamic seal flexing as the shaft is translated.

11. A homogenizer as claimed in claim 10 wherein the dynamic seal is an elastomer seal.

12. A homogenizer comprising:

a block;

a set of pump chambers formed through a first surface of the block;

a seal positioned in each pump chamber along a fluid flow patch of the homogenizer, each seal being located on a radial step within the respective pump chamber adjacent to an axially directed peripheral ridge of a respective retaining member mounted to an end of the block, the seal being flush with the pump chamber and an inner surface of the ridge;

a suction manifold extending through the block;

a set of suction valve bores formed through the block, each suction valve bore in communication with a respective pump chamber;

a suction valve assembly positioned in each of the suction valve bores;

a discharge manifold extending through the block;

a set of discharge valve bores formed through the block, each discharge valve bore in communication with a respective pump chamber;

a discharge valve assembly positioned in each of the discharge valve bores;

a seal positioned in each discharge valve bore along a fluid flow path of the homogenizer, each seal being located along on a radial step within the respective discharge valve bore adjacent to an axially directed peripheral ridge of the respective discharge valve assembly, the seal being flush with the discharge valve bore and an inner surface of the ridge;

a homogenizing valve assembly mounted to the block in communication with the discharge manifold.

13. A homogenizer as claimed in claim 12 further comprising a flow-through pressure gauge assembly mounted between the pump block and the homogenizing valve assembly and having a flow channel in communication with the fluid flow path of the homogenizer, the pressure gauge assembly comprising a pair of seals each being located along the fluid flow path of the homogenizer on a radial step of flow channel of the pressure gauge assembly, the seals being flush with the fluid flow path and the flow channel, the pressure gauge being axially clamped to the pump block so as to secure one of said seals against the pump block and the other of said seals against the homogenizing valve assembly.

14. A homogenizer as claimed in claim 12 wherein homogenizing valve comprises:

a valve body;

a valve seat within the valve body;

a valve member within the valve body spaced adjacent to the valve seat to provide a gap through which the fluid is expressed; and an impact ring surrounding the gap for directing the expressed fluid into a peripheral region, the impact ring being shrink fitting to an axially directed surface of the valve member.

15. A homogenizer as claimed in claim 14 wherein the homogenizing valve further comprises;

an actuator assembly having an actuator rod for actuating the valve member to adjust the gap; and a dynamic seal located adjacent to the peripheral region and coupled to the valve body and the translatable shaft, the dynamic seal flexing as the shaft is translated.

16. A homogenizer as claimed in claim 14 wherein the a dynamic seal is an elastomer seal.

17. A homogenizing valve assembly comprising:

a valve body;

a valve seat located within the valve body;

a valve member located within the valve body spaced adjacent to the valve seat to provide a gap through which the fluid is expressed into a peripheral region;

an actuator assembly having a translatable shaft for actuating the valve member to adjust the gap;

a dynamic seal located adjacent to and exposed to fluid in the peripheral region and coupled to the valve body and the translatable shaft, the dynamic seal flexing as the shaft is translated; and an impact ring surrounding the gap for directing the expressed fluid into a peripheral region, the impact ring being shrink fitted about the valve member.

* * * * *